United States Patent [19]

Rosen et al.

[11] 4,416,069

[45] Nov. 22, 1983

[54] ENHANCEMENT OF COLOR QUALITY OF LUMBER DURING DRYING

[75] Inventors: Howard N. Rosen; Robert E. Bodkin, both of Carbondale; Kenneth D. Gaddis, Johnston City, all of Ill.

[73] Assignee: The United States of America as represented by the Secretary of Agriculture, Washington, D.C.

[21] Appl. No.: 294,096

[22] Filed: Aug. 19, 1981

Related U.S. Application Data

[63] Continuation-in-part of Ser. No. 246,971, Mar. 24, 1981, Pat. No. 4,343,095.

[51] Int. Cl.[3] ..... F26B 7/00

[52] U.S. Cl. ..... 34/13.8; 8/402

[58] Field of Search ..... 34/13.4, 13.8, 16.5; 8/402

[56] References Cited

U.S. PATENT DOCUMENTS

| | | | |
|---|---|---|---|
| 1,021,676 | 3/1912 | Howard | 34/16.5 |
| 1,328,506 | 1/1920 | Fish | 34/13.8 |
| 1,810,659 | 6/1931 | Kritchevsky et al. | 8/402 |
| 4,233,753 | 11/1980 | Olson | 34/13.4 |
| 4,343,095 | 8/1982 | Rosen et al. | 34/16.5 |

*Primary Examiner*—John J. Camby

*Attorney, Agent, or Firm*—M. Howard Silverstein; David G. McConnell

[57] ABSTRACT

A process for darkening wood and thereby enhancing its surface characteristics is disclosed wherein wet wood is dried to about 6 percent moisture content in steam generated from the wood itself at temperatures from 215° to 320° F. and pressures from 15 to 40 psi whereby the wood is darkened through its thickness and thereby making the differentiation between earlywood and latewood in the wood more clearly observable than in wood not processed by this method and, thus, improves the wood grain quality.

9 Claims, No Drawings

ENHANCEMENT OF COLOR QUALITY OF LUMBER DURING DRYING

CROSS-REFERENCE TO RELATED APPLICATIONS

This application is a continuation in part of U.S. application entitled "Pressure Dryer for Steam Seasoning Lumber," Ser. No. 246,971, filed Mar. 24, 1981, now U.S. Pat. No. 4,343,095, issued Aug. 19, 1982 and relates to abandoned application Ser. No. 224,995, filed Jan. 14, 1981, the entire disclosures of which are herein incorporated by reference.

BACKGROUND OF THE INVENTION

1. Field of Invention

When lumber from light-colored species such as yellow-poplar, silver maple, or cottonwood is dried by methods known to those skilled in the art at temperatures below 200° F. (e.g. air drying, dehumidification drying, or conventional kiln drying), the color of the lumber is changed very little as a result of the drying. Although kiln drying at atmospheric pressure above 215° F. temperature with air-stream mixtures can produce darkening of the wood surface, in most cases the colored layer is very thin and subsequently planes off in the surfacing of the lumber. The rich brownish tones obtained with wood dried at temperatures above 212° F. enhances the natural figure of the grain and also tends to reduce the conspicuousness of certain blemishes and discolorations.

Two wood species that have particular color problems associated with the dried lumber are black walnut and yellow-poplar. Black walnut lumber, squares, gunstocks, and other products are steamed for several days in below-ground steaming pits or masonry chambers to darken the light-colored sapwood and, thus, tone down the sharp contrast with the dark heartwood. The reduced contrast between heartwood and sapwood in the steamed lumber aids in the uniform finishing of the final product. The steamed lumber is then dried in another piece of equipment. Yellow-poplar contains light-colored sapwood adjacent to a darker greenish cast heartwood. Because of the coloration in the heartwood, the heartwood is rarely used for products with exposed surfaces. The sapwood is generally stained to improve its color quality.

Lumber that is darker and has clearly defined grain has greater market value than the lighter material. Darker material avoids the conspicuous appearances of scratches, dents, and markings especially desired in furniture products. Thus, darker wood such as walnut and cherry have a higher market value than light woods such as yellow-poplar and soft maple.

2. Description of the Prior Art

It is known that various types of wood may be treated to enhance its color characteristics. In the article in the Forest Products Journal, of November, 1964, entitled "Steaming Walnut for Color," it is suggested that the change in color is most probably due to an oxidation of phenolic substances. The article states several conclusions including the fact that the rate of or speed of color change in walnut sapwood increases as the temperature of the stock is increased. The rate increases sharply between 212° F. and 230° F., but above 230° F., no increase was noted.

U.S. Pat. No. 4,127,946 discloses a method and apparatus for drying materials including wood by contacting the materials with a drying gas consisting essentially of internally generated superheated drying steam above 212° F. However, the pressure at which the steam is present in the drying chamber is less than atmospheric.

U.S. Pat. No. 4,233,753 describes a method for preventing the splitting of logs during drying, wherein the logs are placed in a chamber, the chamber sealed and steam is added to about atmospheric pressure.

U.S. Pat. No. 4,246,704 describes a process for drying solid wood in the form of planks by means of superheated steam. This patent includes the description of the insertion of wood into a dryer followed by the evacuation of the dryer by a vacuum pump, followed by the introduction of steam into the chamber at substantially atmospheric pressure.

U.S. Pat. No. 4,233,752 describes an apparatus and process for treating wood in a hermetically sealed chamber wherein a vacuum is applied, followed by the introduction of a fluid which may be steam, and an increase in pressure.

Reference is also made to U.S. Pat. No. 4,058,906, which describes a process for drying wood, but at subatmospheric pressure.

However, none of these processes produce a product as obtained by the process of the present invention.

SUMMARY OF THE INVENTION

The main objective of this invention is to provide a method for darkening lumber throughout its thickness without damaging its structural quality.

An objective of this invention is to simultaneously dry and darken lumber.

Another objective is to reduce the contrast between heartwood and sapwood of walnut lumber.

Another objective is to reduce the contrast between the heartwood and sapwood of yellow-poplar and also reduce the greenish cast in the heartwood.

A final objective of the invention is to accentuate the grain in lumber.

DESCRIPTION OF THE PREFERRED EMBODIMENTS

In accordance with the present invention, wood, which is in the "green" state or which has been air-dried to 20–30 percent moisture content, is subjected to a circulating atmosphere of steam generated by the drying wood, in a tank or retort. Air is initially removed by vacuum pump and a suitable device such as a fan or pump is used to circulate the steam generated from the wood in the tank or retort. Temperatures can range from 215° to no higher than 320° F. to avoid structural damage to the wood. Pressures can range from 15 to 40 psi, but are controlled at a fixed value in this range so that the steam can be released from the steaming tank as the lumber dries to about 6 percent moisture content required for lumber used to make furniture grade and dimension lumber products. Equipment, such as described in abandoned application Ser. No. 224,995, entitled "Pressure Dryer for Steam Seasoning Lumber," can be used for this purpose.

The temperature and time of exposure to the steam will vary for wood thickness, wood species, and degree of darkening desired and can vary from several hours to several days. The darkening in the wood is a result of chemical modifications in the lignin and extractives contained in the wood ultrastructure. The chemical reactions which result in these modifications are activated by increased temperatures. Since steam is a better heat conductor and transfer fluid than air, the wood rapidly becomes hot throughout the thickness and darkening of the wood occurs in the center as well as at the surface of the wood. The darkening is more noticeable in the more dense latewood of the wood; and, thus, grain structure is more clearly defined as the entire board darkens.

After the lumber is steam dried, the surface or surfaces of the wood are sanded, planed or jointed, or otherwise machined to expose the darkened surfaces for use in making the final products.

EXAMPLES

Example 1

Yellow-poplar lumber, 8 feet long by 4 to 6 inches in width and 1 inch thick, 75 to 115 percent initial moisture content, was steam dried at 300° F. and 30 psi for 20 hours in a chamber as described in U.S. Ser. No. 246,971, after first evacuating the air. The wood was structurally sound, but was darkened considerably compared to similar lumber dried in a standard lumber drying kiln. The green case of the heartwood was not nearly as noticeable in the steam-darkened lumber. Colorametric tests run on yellow-poplar sapwood and heartwood comparing steam-dried and standard kiln-dried gave the following results.

TABLE 1

Colorametric analysis of steam-dried and kiln-dried yellow-poplar lumber

| | Purity (Percent) | Dominant wavelength (Millimicrons) | Brightness (Percent) |
|---|---|---|---|
| Heartwood | | | |
| Kiln-dried | 19.4 | 575.3 | 56.2 |
| Steam-dried | 34.4 | 578.3 | 36.4 |
| Sapwood | | | |
| Kiln-dried | 19.7 | 577.7 | 70.5 |
| Steam-dried | 31.5 | 580.0 | 43.3 |

A significant decrease in brightness in both sapwood and heartwood was recorded when kiln-dried material was compared with steam-dried material. Color shifted from green-yellow to yellow-orange in the heartwood and yellow to yellow-orange in the sapwood with greater purity in steam-dried than kiln-dried material.

Example 2

Black walnut lumber, 8 feet long by 4 to 6 inches wide and 1 inch thick, 60 to 85 percent initial moisture content, was steam dried at 260° F. and 19 psi for 30 hours in an apparatus as described in Example 1. The wood was structurally sound. The heartwood was slightly darker than similar material that was conventionally dried, but the sapwood was considerably darker and the transition between heartwood and sapwood was not nearly as noticeable in the steam-dried lumber as in the standard kiln-dried lumber.

I claim:

1. A process for simultaneously drying and darkening lumber throughout its thickness by subjecting the lumber to steam generated by the drying wood in the absence of air at temperatures from 215° to 320° F. and pressures from 15 to 40 psi.

2. The process of claim 1 wherein the lumber is black walnut and the contrast between the heartwood and sapwood of the black walnut is reduced.

3. The process of claim 1 wherein the lumber is from light colored species and the grain is accentuated and the light colored species is yellow-poplar, cottonwood, or silver maple.

4. The process of claim 1 wherein the lumber is yellow-poplar and the greenish cast in the yellow-poplar heartwood is removed and the contrast between heartwood and sapwood is reduced.

5. The process of claim 2 wherein the temperature is about 260° F. and the pressure 19 psi and the drying takes place over a period of about 30 hours.

6. The process of claim 4 wherein the temperature is about 300° F., the pressure 30 psi and the drying takes place for about 20 hours.

7. A process as claimed in claim 1, wherein steam is removed so that the lumber is dried to about 6 percent moisture content.

8. A process as claimed in claim 5, wherein steam is removed so that the lumber is dried to a moisture content of about 6 percent.

9. A process as claimed in claim 6, wherein steam is removed and the lumber is dried to a moisture content of about 6 percent.

* * * * *